US010119308B2

(12) United States Patent
Linden et al.

(10) Patent No.: US 10,119,308 B2
(45) Date of Patent: Nov. 6, 2018

(54) POWERED LATCH SYSTEM FOR VEHICLE DOORS AND CONTROL SYSTEM THEREFOR

(71) Applicant: Ford Global Technologies, LLC, Dearborn, MI (US)

(72) Inventors: H. Paul Tsvi Linden, Oak Park, MI (US); Daniel Carl Bejune, Southfield, MI (US); John Robert Van Wiemeersch, Novi, MI (US); Robert Bruce Kleve, Ann Arbor, MI (US); John Thomas Ricks, Taylor, MI (US); Kosta Papanikolaou, Hungtington Woods, MI (US); Noah Barlow Mass, Ann Arbor, MI (US); Lisa Therese Boran, Northville, MI (US); Ronald Patrick Brombach, Plymouth, MI (US); Jim Michael Weinfurther, Farmington, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 801 days.

(21) Appl. No.: 14/280,035

(22) Filed: May 16, 2014

(65) Prior Publication Data

US 2015/0330114 A1 Nov. 19, 2015

Related U.S. Application Data

(63) Continuation-in-part of application No. 14/276,415, filed on May 13, 2014.

(51) Int. Cl.
*E05B 81/00* (2014.01)
*E05B 77/30* (2014.01)
(Continued)

(52) U.S. Cl.
CPC ..... *E05B 81/00* (2013.01); *E05B 77/30* (2013.01); *E05B 77/48* (2013.01); *E05B 77/54* (2013.01);
(Continued)

(58) Field of Classification Search
CPC ..... E05B 81/00; E05B 81/64
(Continued)

(56) References Cited

U.S. PATENT DOCUMENTS 2,229,909 A 1/1941 Wread
2,553,023 A 5/1951 Walters
(Continued)

FOREIGN PATENT DOCUMENTS

CN 1232936 C 12/2005
CN 201198681 Y 2/2009
(Continued)

OTHER PUBLICATIONS

Department of Transportation, "Federal Motor Vehicle Safety Standards; Door Locks and Door Retention Components and Side Impact Protection," http://www.nhtsa.gov/cars/rules/rulings/DoorLocks/DoorLocks_NPRM.html#VI_C, 23 pages, Aug. 28, 2010.
(Continued)

*Primary Examiner* — Carlos Lugo
(74) *Attorney, Agent, or Firm* — Jason Rogers; Price Heneveld LLP

(57) ABSTRACT

A latch system for vehicle doors includes a powered latch including a powered actuator that is configured to unlatch the powered latch. An interior unlatch input feature such as an unlatch switch can be actuated by a user to provide an unlatch request. The system may include a controller that is operably connected to the powered actuator of the powered latch. The controller is configured such that it does not unlatch the powered latch if a vehicle speed is greater than
(Continued)

a predefined value unless the interior latch feature is actuated at least two times according to predefined criteria.

3 Claims, 3 Drawing Sheets

(51) Int. Cl.
*E05B 77/48* (2014.01)
*E05B 77/54* (2014.01)
*E05B 81/14* (2014.01)
*E05B 81/76* (2014.01)
*E05B 81/64* (2014.01)

(52) U.S. Cl.
CPC ..... *E05B 81/14* (2013.01); *E05B 81/76* (2013.01); *E05B 81/64* (2013.01); *Y10T 292/1043* (2015.04)

(58) Field of Classification Search
USPC ..... 292/194, 201; 340/5.72, 426.28
See application file for complete search history.

(56) References Cited

U.S. PATENT DOCUMENTS 3,479,767 A 11/1969 Gardner et al.
3,605,459 A 9/1971 Van Dalen
3,751,718 A 8/1973 Hanchett
3,771,823 A 11/1973 Schnarr
3,854,310 A * 12/1974 Paull ..... E05B 47/0012 292/201
3,858,922 A 1/1975 Yamanaka
4,193,619 A 3/1980 Jeril
4,206,491 A 6/1980 Ligman et al.
4,425,597 A 1/1984 Schramm
4,457,148 A 7/1984 Johansson et al.
4,640,050 A 2/1987 Yamagishi et al.
4,672,348 A 6/1987 Duve
4,674,230 A 6/1987 Takeo et al.
4,674,781 A 6/1987 Reece et al.
4,702,117 A 10/1987 Tsutsumi et al.
4,848,031 A 6/1989 Yamagishi et al.
4,858,971 A * 8/1989 Haag ..... E05B 77/48 292/201
4,889,373 A 12/1989 Ward et al.
4,929,007 A 5/1990 Bartczak et al.
5,018,057 A 5/1991 Biggs et al.
5,056,343 A 10/1991 Kleefeldt et al.
5,058,258 A 10/1991 Harvey
5,074,073 A 12/1991 Zwebner
5,092,637 A 3/1992 Miller
5,239,779 A 8/1993 Deland et al.
5,263,762 A 11/1993 Long et al.
5,297,010 A 3/1994 Camarota et al.
5,332,273 A 7/1994 Komachi
5,334,969 A 8/1994 Abe et al.
5,494,322 A 2/1996 Menke
5,497,641 A 3/1996 Linde et al.
5,535,608 A 7/1996 Brin
5,547,208 A 8/1996 Chappell et al.
5,551,187 A 9/1996 Brouwer et al.
5,581,230 A 12/1996 Barrett
5,583,405 A 12/1996 Sai et al.
5,613,716 A 3/1997 Cafferty
5,618,068 A 4/1997 Mitsui et al.
5,632,120 A 5/1997 Shigematsu et al.
5,632,515 A 5/1997 Dowling
5,644,869 A 7/1997 Buchanan, Jr.
5,653,484 A 8/1997 Brackmann et al.
5,662,369 A 9/1997 Tsuge
5,684,470 A 11/1997 Deland et al.
5,744,874 A 4/1998 Yoshida et al.
5,755,059 A 5/1998 Schap
5,783,994 A 7/1998 Koopman, Jr. et al.
5,802,894 A 9/1998 Jahrsetz et al.
5,808,555 A * 9/1998 Bartel ..... E05B 77/48 307/10.2
5,852,944 A 12/1998 Collard, Jr. et al.
5,859,479 A * 1/1999 David ..... B60Q 1/46 292/DIG. 65
5,895,089 A 4/1999 Singh et al.
5,896,026 A 4/1999 Higgins
5,896,768 A 4/1999 Cranick et al.
5,898,536 A 4/1999 Won
5,901,991 A 5/1999 Hugel et al.
5,921,612 A 7/1999 Mizuki et al.
5,927,794 A 7/1999 Mobius
5,964,487 A 10/1999 Shamblin
5,979,754 A 11/1999 Martin et al.
5,992,194 A 11/1999 Baukholt et al.
6,000,257 A 12/1999 Thomas
6,027,148 A 2/2000 Shoemaker
6,038,895 A 3/2000 Menke et al.
6,042,159 A 3/2000 Spitzley et al.
6,043,735 A 3/2000 Barrett
6,050,117 A 4/2000 Weyerstall
6,056,076 A 5/2000 Bartel et al.
6,065,316 A 5/2000 Sato et al.
6,072,403 A * 6/2000 Iwasaki ..... G07C 9/00309 180/287
6,075,294 A 6/2000 Van den Boom et al.
6,089,626 A 7/2000 Shoemaker
6,091,162 A 7/2000 Williams, Jr. et al.
6,099,048 A 8/2000 Salmon et al.
6,125,583 A 10/2000 Murray et al.
6,130,614 A 10/2000 Miller
6,145,918 A 11/2000 Wilbanks, II
6,157,090 A 12/2000 Vogel
6,181,024 B1 * 1/2001 Geil ..... E05B 85/10 180/287
6,198,995 B1 3/2001 Settles et al.
6,241,294 B1 6/2001 Young et al.
6,247,343 B1 * 6/2001 Weiss ..... E05B 81/78 292/336.3
6,256,932 B1 7/2001 Jyawook et al.
6,271,745 B1 8/2001 Anazi et al.
6,341,448 B1 1/2002 Murray
6,361,091 B1 3/2002 Weschler
6,405,485 B1 6/2002 Itami et al.
6,441,512 B1 8/2002 Jakel et al.
6,460,905 B2 10/2002 Suss
6,470,719 B1 10/2002 Franz et al.
6,480,098 B2 11/2002 Flick
6,515,377 B1 2/2003 Uberlein et al.
6,523,376 B2 2/2003 Baukholt et al.
6,550,826 B2 4/2003 Fukushima et al.
6,554,328 B2 4/2003 Cetnar et al.
6,556,900 B1 4/2003 Brynielsso
6,602,077 B2 8/2003 Kasper et al.
6,606,492 B1 8/2003 Losey
6,629,711 B1 10/2003 Gleason et al.
6,639,161 B2 10/2003 Meagher et al.
6,657,537 B1 12/2003 Hauler
6,659,515 B2 12/2003 Raymond et al.
6,701,671 B1 3/2004 Fukumoto et al.
6,712,409 B2 3/2004 Monig
6,734,578 B2 5/2004 Konno et al.
6,740,834 B2 5/2004 Sueyoshi et al.
6,768,413 B1 7/2004 Kemmann et al.
6,779,372 B2 8/2004 Arlt et al.
6,783,167 B2 * 8/2004 Bingle ..... B60Q 3/06 292/DIG. 43
6,786,070 B1 9/2004 Dimig et al.
6,794,837 B1 9/2004 Whinnery et al.
6,825,752 B2 11/2004 Nahata et al.
6,829,357 B1 12/2004 Alrabady et al.
6,843,085 B2 1/2005 Dimig
6,854,870 B2 2/2005 Huizenga
6,879,058 B2 4/2005 Lorenz et al.
6,883,839 B2 4/2005 Belmond et al.
6,914,346 B2 7/2005 Girard
6,923,479 B2 8/2005 Aiyama et al.
6,933,655 B2 8/2005 Morrison et al.

(56) References Cited

U.S. PATENT DOCUMENTS 6,946,978 B2 9/2005 Schofield
7,005,959 B2 * 2/2006 Amagasa ..... E05B 81/78 307/10.1
7,038,414 B2 5/2006 Daniels et al.
7,055,997 B2 6/2006 Baek
7,062,945 B2 6/2006 Saitoh et al.
7,070,018 B2 * 7/2006 Kachouh ..... E05B 81/14 180/287
7,070,213 B2 7/2006 Willats et al.
7,090,285 B2 8/2006 Markevich et al.
7,091,823 B2 8/2006 Ieda et al.
7,091,836 B2 * 8/2006 Kachouh ..... E05B 81/14 307/10.1
7,097,226 B2 8/2006 Bingle et al.
7,106,171 B1 9/2006 Burgess
7,108,301 B2 9/2006 Louvel
7,126,453 B2 10/2006 Sandau et al.
7,145,436 B2 12/2006 Ichikawa et al.
7,161,152 B2 1/2007 Dipoala
7,170,253 B2 1/2007 Spurr et al.
7,173,346 B2 2/2007 Aiyama et al.
7,176,810 B2 2/2007 Inoue
7,180,400 B2 2/2007 Amagasa
7,192,076 B2 3/2007 Ottino
7,204,530 B2 4/2007 Lee
7,205,777 B2 4/2007 Schultz et al.
7,221,255 B2 5/2007 Johnson et al.
7,222,459 B2 5/2007 Taniyama
7,248,955 B2 7/2007 Hein et al.
7,263,416 B2 8/2007 Sakurai et al.
7,270,029 B1 9/2007 Papanikolaou et al.
7,325,843 B2 2/2008 Coleman et al.
7,342,373 B2 3/2008 Newman et al.
7,360,803 B2 4/2008 Parent et al.
7,363,788 B2 4/2008 Dimig et al.
7,375,299 B1 5/2008 Pudney
7,399,010 B2 7/2008 Hunt et al.
7,446,645 B2 11/2008 Steegmann
7,576,631 B1 8/2009 Bingle et al.
7,642,669 B2 1/2010 Spurr
7,686,378 B2 3/2010 Gisler et al.
7,688,179 B2 3/2010 Kurpinski et al.
7,705,722 B2 4/2010 Shoemaker et al.
7,747,286 B2 6/2010 Conforti
7,780,207 B2 8/2010 Gotou et al.
7,791,218 B2 9/2010 Mekky et al.
7,926,385 B2 4/2011 Papanikolaou et al.
7,931,314 B2 4/2011 Nitawaki et al.
7,937,893 B2 5/2011 Pribisic
8,028,375 B2 10/2011 Nakaura et al.
8,093,987 B2 1/2012 Kurpinski et al.
8,126,450 B2 2/2012 Howarter et al.
8,141,296 B2 3/2012 Bem
8,141,916 B2 3/2012 Tomaszewski et al.
8,169,317 B2 5/2012 Lemerand et al.
8,193,462 B2 6/2012 Zanini et al.
8,224,313 B2 7/2012 Howarter et al.
8,376,416 B2 2/2013 Arabia, Jr. et al.
8,398,128 B2 3/2013 Arabia et al.
8,405,515 B2 3/2013 Ishihara et al.
8,405,527 B2 3/2013 Chung et al.
8,419,114 B2 * 4/2013 Fannon ..... E05B 83/24 180/69.2
8,451,087 B2 5/2013 Krishnan et al.
8,454,062 B2 6/2013 Rohlfing et al.
8,474,889 B2 7/2013 Reifenberg et al.
8,532,873 B1 9/2013 Bambenek
8,543,101 B2 9/2013 Mette et al.
8,544,901 B2 10/2013 Krishnan et al.
8,573,657 B2 11/2013 Papanikolaou et al.
8,584,402 B2 11/2013 Yamaguchi
8,616,595 B2 12/2013 Wellborn, Sr. et al.
8,648,689 B2 2/2014 Hathaway et al.
8,746,755 B2 6/2014 Papanikolaou et al.
8,826,596 B2 9/2014 Tensing
8,833,811 B2 9/2014 Ishikawa
8,903,605 B2 12/2014 Bambenek
8,915,524 B2 12/2014 Charnesky
8,963,701 B2 2/2015 Rodriguez
8,965,287 B2 2/2015 Lam
9,003,707 B2 4/2015 Reddmann
9,076,274 B2 7/2015 Kamiya
9,159,219 B2 10/2015 Magner et al.
9,184,777 B2 11/2015 Esselink et al.
9,187,012 B2 11/2015 Sachs et al.
9,189,900 B1 11/2015 Penilla et al.
9,260,882 B2 2/2016 Krishnan et al.
9,284,757 B2 * 3/2016 Kempel ..... E05B 83/26
9,322,204 B2 4/2016 Suzuki
9,353,566 B2 5/2016 Miu et al.
9,382,741 B2 7/2016 Konchan et al.
9,405,120 B2 8/2016 Graf
9,409,579 B2 8/2016 Eichin et al.
9,416,565 B2 8/2016 Papanikolaou et al.
9,475,369 B2 10/2016 Sugiura
9,481,325 B1 11/2016 Lange
9,493,975 B1 11/2016 Li
9,518,408 B1 12/2016 Krishnan
9,522,590 B2 12/2016 Fujimoto et al.
9,546,502 B2 1/2017 Lange
9,551,166 B2 1/2017 Patel et al.
9,725,069 B2 8/2017 Krishnan
9,777,528 B2 10/2017 Elie et al.
9,797,178 B2 10/2017 Elie et al.
9,834,964 B2 12/2017 Van Wiemeersch et al.
9,845,071 B1 12/2017 Krishnan
9,903,142 B2 2/2018 Van Wiemeersch et al.
9,909,344 B2 3/2018 Krishnan et al.
9,957,737 B2 5/2018 Patel et al.
2001/0005078 A1 6/2001 Fukushima et al.
2001/0030871 A1 10/2001 Anderson
2002/0000726 A1 1/2002 Zintler
2002/0111844 A1 8/2002 Vanstory et al.
2002/0121967 A1 9/2002 Bowen et al.
2002/0186144 A1 12/2002 Meunier
2003/0009855 A1 1/2003 Budzynski
2003/0025337 A1 * 2/2003 Suzuki ..... E05B 81/20 292/195
2003/0038544 A1 2/2003 Spurr
2003/0101781 A1 6/2003 Budzynski et al.
2003/0107473 A1 6/2003 Pang et al.
2003/0111863 A1 * 6/2003 Weyerstall ..... E05B 79/20 296/146.1
2003/0139155 A1 7/2003 Sakai
2003/0172695 A1 9/2003 Buschmann
2003/0182863 A1 10/2003 Mejean et al.
2003/0184098 A1 10/2003 Aiyama
2004/0061462 A1 4/2004 Bent et al.
2004/0093155 A1 5/2004 Simonds et al.
2004/0195845 A1 10/2004 Chevalier
2004/0217601 A1 11/2004 Gamault et al.
2005/0057047 A1 3/2005 Kachouch
2005/0068712 A1 * 3/2005 Schulz ..... E05B 81/78 361/287
2005/0216133 A1 9/2005 MacDougall et al.
2005/0218913 A1 10/2005 Inaba
2006/0100002 A1 3/2006 Call
2006/0186987 A1 * 8/2006 Wilkins ..... B60R 25/252 340/5.53
2007/0001467 A1 * 1/2007 Muller ..... E05B 81/06 292/336.3
2007/0090654 A1 4/2007 Eaton
2007/0115191 A1 5/2007 Hashiguchi et al.
2007/0120645 A1 * 5/2007 Nakashima ..... G07C 9/00309 340/5.61
2007/0126243 A1 6/2007 Papanikolaou et al.
2007/0132553 A1 6/2007 Nakashima
2007/0170727 A1 7/2007 Kohlstrand et al.
2008/0021619 A1 1/2008 Steegmann et al.
2008/0060393 A1 3/2008 Johansson et al.
2008/0068129 A1 3/2008 Ieda et al.
2008/0129446 A1 6/2008 Vader
2008/0143139 A1 6/2008 Bauer et al.
2008/0202912 A1 8/2008 Boddie et al.

(56) References Cited

U.S. PATENT DOCUMENTS

2008/0203737 A1 8/2008 Tomaszewski et al.
2008/0211623 A1 9/2008 Scheurich
2008/0217956 A1 9/2008 Gschweng et al.
2008/0224482 A1 9/2008 Cumbo et al.
2008/0230006 A1 9/2008 Kirchoff et al.
2008/0250718 A1 10/2008 Papanikolaou et al.
2008/0296927 A1 12/2008 Gisler et al.
2008/0303291 A1 12/2008 Spurr
2008/0307711 A1 12/2008 Kern et al.
2009/0033104 A1 2/2009 Konchan et al.
2009/0033477 A1 2/2009 Illium et al.
2009/0145181 A1 6/2009 Pecoul et al.
2009/0160211 A1 6/2009 Krishnan et al.
2009/0177336 A1 7/2009 McClellan et al.
2009/0240400 A1 9/2009 Lachapelle et al.
2009/0257241 A1 10/2009 Meinke et al.
2010/0007463 A1 1/2010 Dingman et al.
2010/0052337 A1 3/2010 Arabia et al.
2010/0060505 A1 3/2010 Witkowski
2010/0097186 A1 4/2010 Wielebski
2010/0175945 A1 7/2010 Helms
2010/0235057 A1 9/2010 Papanikolaou et al.
2010/0235058 A1 9/2010 Papanikolaou et al.
2010/0235059 A1 9/2010 Krishnan et al.
2010/0237635 A1 9/2010 Ieda et al.
2010/0253535 A1 10/2010 Thomas
2010/0265034 A1 10/2010 Cap et al.
2010/0315267 A1* 12/2010 Chung ..... B60R 25/24 341/22
2011/0041409 A1 2/2011 Newman et al.
2011/0060480 A1 3/2011 Mottla et al.
2011/0148575 A1 6/2011 Sobecki et al.
2011/0154740 A1 6/2011 Matsumoto et al.
2011/0180350 A1 7/2011 Thacker
2011/0203181 A1 8/2011 Magner et al.
2011/0203336 A1 8/2011 Mette et al.
2011/0227351 A1 9/2011 Grosdemouge
2011/0248862 A1 10/2011 Budampati
2011/0252845 A1 10/2011 Webb et al.
2011/0254292 A1 10/2011 Ishii
2011/0313937 A1 12/2011 Moore, Jr. et al.
2012/0119524 A1 5/2012 Bingle et al.
2012/0154292 A1 6/2012 Zhao et al.
2012/0180394 A1 7/2012 Shinohara
2012/0205925 A1 8/2012 Muller et al.
2012/0228886 A1 9/2012 Muller et al.
2012/0252402 A1 10/2012 Jung
2013/0049403 A1 2/2013 Fannon et al.
2013/0069761 A1 3/2013 Tieman
2013/0079984 A1 3/2013 Aerts et al.
2013/0104459 A1 5/2013 Patel et al.
2013/0127180 A1 5/2013 Heberer et al.
2013/0138303 A1 5/2013 McKee et al.
2013/0207794 A1* 8/2013 Patel ..... B60K 35/00 340/425.5
2013/0282226 A1 10/2013 Pollmann
2013/0295913 A1 11/2013 Matthews, III et al.
2013/0311046 A1 11/2013 Heberer et al.
2013/0321065 A1 12/2013 Salter et al.
2013/0325521 A1 12/2013 Jameel
2014/0000165 A1 1/2014 Patel et al.
2014/0007404 A1 1/2014 Krishnan et al.
2014/0015637 A1 1/2014 Dassanakake et al.
2014/0088825 A1 3/2014 Lange et al.
2014/0129113 A1 5/2014 Van Wiemeersch et al.
2014/0150581 A1 6/2014 Scheuring et al.
2014/0156111 A1 6/2014 Ehrman
2014/0188999 A1 7/2014 Leonard et al.
2014/0200774 A1 7/2014 Lange et al.
2014/0227980 A1 8/2014 Esselink et al.
2014/0242971 A1 8/2014 Aladenize et al.
2014/0245666 A1 9/2014 Ishida et al.
2014/0256304 A1 9/2014 Frye et al.
2014/0278599 A1 9/2014 Reh
2014/0293753 A1 10/2014 Pearson
2014/0338409 A1 11/2014 Kraus et al.
2014/0347163 A1 11/2014 Banter et al.
2015/0001926 A1 1/2015 Kageyama et al.
2015/0048927 A1 2/2015 Simmons
2015/0059250 A1 3/2015 Miu et al.
2015/0084739 A1 3/2015 Lemoult et al.
2015/0149042 A1 5/2015 Cooper et al.
2015/0161832 A1 6/2015 Esselink et al.
2015/0197205 A1 7/2015 Xiong
2015/0240548 A1 8/2015 Bendel et al.
2015/0294518 A1 10/2015 Peplin
2015/0330112 A1 11/2015 Van Wiemeersch et al.
2015/0330113 A1 11/2015 Van Wiemeersch et al.
2015/0330114 A1 11/2015 Linden et al.
2015/0330117 A1 11/2015 Van Wiemeersch et al.
2015/0360545 A1 12/2015 Nanla
2015/0371031 A1 12/2015 Ueno et al.
2016/0060909 A1 3/2016 Krishnan et al.
2016/0130843 A1 5/2016 Bingle
2016/0138306 A1 5/2016 Krishnan et al.
2016/0153216 A1 6/2016 Funahashi et al.
2016/0326779 A1 11/2016 Papanikolaou et al.
2017/0014039 A1 1/2017 Pahlevan et al.
2017/0074006 A1 3/2017 Patel et al.
2017/0247016 A1 8/2017 Krishnan
2017/0270490 A1 9/2017 Penilla et al.
2017/0306662 A1 10/2017 Och et al.
2017/0349146 A1 12/2017 Krishnan
2018/0038147 A1 2/2018 Linden et al.
2018/0051493 A1 2/2018 Krishnan et al.
2018/0051498 A1 2/2018 Van Wiemeersch et al.
2018/0058128 A1 3/2018 Khan et al.
2018/0065598 A1 3/2018 Krishnan
2018/0080270 A1 3/2018 Khan et al.
2018/0128022 A1 5/2018 Van Wiemeersh et al.

FOREIGN PATENT DOCUMENTS

CN 201280857 7/2009
CN 101527061 A 9/2009
CN 201567872 U 9/2010
CN 101932466 A 12/2010
CN 201915717 U 8/2011
CN 202200933 U 4/2012
CN 202686247 U 1/2013
CN 103206117 A 7/2013
CN 103264667 A 8/2013
CN 203511548 U 4/2014
CN 204326814 U 5/2015
DE 4403655 A1 8/1995
DE 19620059 A1 11/1997
DE 19642698 A2 11/2000
DE 19642698 C2 11/2000
DE 10212794 A1 6/2003
DE 20121915 U1 11/2003
DE 10309821 A1 9/2004
DE 102005041551 A1 3/2007
DE 102006029774 A1 1/2008
DE 102006041928 A1 3/2008
DE 102010052582 A1 5/2012
DE 102011051165 A1 12/2012
DE 102015101164 A1 7/2015
DE 102014107809 A1 12/2015
EP 0372791 A2 6/1990
EP 0694664 A1 1/1996
EP 1162332 A1 12/2001
EP 1284334 A1 2/2003
EP 1288403 A2 3/2003
EP 1284334 A1 9/2003
EP 1460204 A2 9/2004
EP 1465119 A1 10/2004
EP 1338731 A3 2/2005
EP 1944436 A2 7/2008
EP 2053744 A2 4/2009
EP 2314803 A2 4/2011
FR 2698838 A1 6/1994
FR 2783547 A1 3/2000
FR 2841285 A1 12/2003
FR 2948402 A1 7/2009

(56) References Cited

FOREIGN PATENT DOCUMENTS

| | | | |
|---|---|---|---|
| FR | 2955604 | A1 | 7/2011 |
| GB | 2402840 | A | 12/2004 |
| GB | 2496754 | A | 5/2013 |
| JP | 62255256 | A | 11/1987 |
| JP | 05059855 | A | 3/1993 |
| JP | 06167156 | A | 6/1994 |
| JP | 106185250 | A | 7/1994 |
| JP | 2000064685 | A | 2/2000 |
| JP | 2000314258 | A | 11/2000 |
| JP | 2007138500 | A | 6/2007 |
| KR | 20030025738 | A | 3/2003 |
| KR | 20120108580 | A | 10/2012 |
| WO | 0123695 | A1 | 4/2001 |
| WO | 03095776 | A1 | 11/2003 |
| WO | 2013111615 | A1 | 8/2013 |
| WO | 2013146918 | A1 | 10/2013 |
| WO | 2014146186 | A1 | 9/2014 |

OTHER PUBLICATIONS

U.S. Appl. No. 14/276,415, filed May 13, 2014, entitled "Customer Coaching Method for Location of-Latch Backup Handles."
U.S. Appl. No. 14/281,998, filed May 20, 2014, entitled "Vehicle Door Handle and Powered Latch System."
U.S. Appl. No. 14/282,224, filed May 20, 2014, entitled "Powered Vehicle Door Latch and Exterior Handle With Sensor."
Kistler Instruments, "Force Sensors Ensure Car Door Latch is Within Specification," Article, Jan. 1, 2005, 3 pages.
Zipcar.com, "Car Sharing from Zipcar: How Does car Sharing Work?" Feb. 9, 2016, 6 pages.
PRWEB, "Keyfree Technologies Inc. Launches the First Digital Car Key," Jan. 9, 2014, 3 pages.
"Push Button to open your car door" Online video clip. YouTube, Mar. 10, 2010. 1 page.
Car of the Week: 1947 Lincoln convertible by: bearnest May 29, 2012 http://www.oldcarsweekly.com/car-of-the-week/car-of-the-week-1947-lincoln-convertible. 7 pages.
U.S. Appl. No. 14/276,415, Office Action dated Mar. 28, 2018, 19 pages.
U.S. Appl. No. 12/402,744, Office Action dated Oct. 23, 2013, 7 pages.
U.S. Appl. No. 12/402,744, Advisory Action dated Jan. 31, 2014, 2 pages.
U.S. Appl. No. 14/280,035, filed May 16, 2014, entitled "Powered Latch System for Vehicle Doors and Control System Therefor."
Keyfree Technologies Inc., "Keyfree," website, Jan. 10, 2014, 2 pages.
Hyundai Motor India Limited, "Hyundai Care," website, Dec. 8, 2015, 3 pages.
George Kennedy, "Keyfree app replaces conventional keys with your smart phone," website, Jan. 5, 2015, 2 pages.
Office Action dated Mar. 10, 2017, U.S. Appl. No. 15/174,206, filed Jun. 6, 2016, 17 pages.
General Motors Corporation, 2006 Chevrolet Corvette Owner Manual, © 2005 General Motors Corporation, 4 pages.
General Motors LLC, 2013 Chevrolet Corvette Owner Manual, 2012, 17 pages.
General Motors, "Getting to Know Your 2014 Corvette," Quick Reference Guide, 2013, 16 pages.
InterRegs Ltd., Federal Motor Vehicle Safety Standard, "Door Locks and Door Retention Components," 2012, F.R. vol. 36 No. 232—Feb. 12, 1971, 23 pages.
Ross Downing, "How to Enter & Exit a Corvette With a Dead Battery," YouTube video http://www.youtube.com/watch?v=DLDqmGQU6L0, Jun. 6, 2011, 1 page.
Jeff Glucker, "Friends videotape man 'trapped' inside C6 Corette with dead battery," YouTube via Corvett Online video http://www.autoblog.com/2011/05/14/friends-videotape-man-trapped-inside-c6-corvette-with-dead-bat/, May 14, 2011, 1 page.
Don Roy, "ZR1 Owner Calls 911 After Locking Self in Car," website http://www.corvetteonline.com/news/zr1-owner-calls-911-after-locking-self-in-car/, Apr. 13, 2011, 2 pages.
Zach Bowman, "Corvette with dead battery traps would-be thief," website http://www.autoblog.com/2011/10/25/corvette-with-dead-battery-traps-would-be-thief/, Oct. 25, 2011, 2 pages.
U.S. Appl. No. 14/468,634, filed Aug. 26, 2014, 15 pages.
U.S. Appl. No. 13/608,303, filed Sep. 10, 2012, 15 pages.
Bryan Laviolette, "GM's New App Turns Smartphones into Virtual Keys," Article, Jul. 22, 2010, 2 pages.
Hyundai Bluelink, "Send Directions to your car," Link to App, 2015, 3 pages.

* cited by examiner

POWERED LATCH SYSTEM FOR VEHICLE DOORS AND CONTROL SYSTEM THEREFOR

CROSS-REFERENCE TO RELATED APPLICATION

This patent application is a continuation-in-part of U.S. patent application Ser. No. 14/276,415, which was filed on May 13, 2014, entitled "CUSTOMER COACHING METHOD FOR LOCATION OF E-LATCH BACKUP HANDLES" the entire disclosure of which is incorporated herein by reference.

FIELD OF THE INVENTION

The present invention generally relates to latches for doors of motor vehicles, and more particularly, to a powered latch system and controller that only unlatches the powered latch if predefined operating conditions/parameters are present.

BACKGROUND OF THE INVENTION

Electrically powered latches ("E-latches") have been developed for motor vehicles. Known powered door latches may be unlatched by actuating an electrical switch. Actuation of the switch causes an electric motor to shift a pawl to a released/unlatched position that allows a claw of the latch to move and disengage from a striker to permit opening of the vehicle door. E-latches may include a mechanical emergency/backup release lever that can be manually actuated from inside the vehicle to unlatch the powered latch if the powered latch fails due to a loss of electrical power or other malfunction.

SUMMARY OF THE INVENTION

One aspect of the present invention is a latch system for vehicle doors. The latch system includes a powered latch including a powered actuator that is configured to unlatch the powered latch. An interior unlatch input feature such as an unlatch switch can be actuated by a user to provide an unlatch request.

The system may include a controller that is operably connected to the powered latch. The controller may be configured (i.e. programmed) such that it does not unlatch the powered latch if a vehicle speed is greater than a predefined value unless the interior latch feature is actuated at least two times within a predefined period of time.

In addition to the unlatch switch, the latch system may include an unlock input feature such as an unlock switch mounted on an inner side of a vehicle door that can be actuated by a user to provide an unlock request. The controller may be in communication with both the interior unlatch switch and the unlock switch. The controller may be configured to cause the powered latch to unlatch if a total of at least three discreet inputs in any combination are received from the interior unlatch input feature and/or the unlock input feature within a predefined time interval. The at least three discreet inputs are selected from a group including an unlatch request and an unlock request.

The system may include a control module that is configured to detect a crash event and cause airbags and/or other passenger constraints to be deployed. The controller may be configured to communicate with the control module by only a selected one of a digital data communication network and one or more electrical conductors extending between the controller and the control module. The controller is configured to operate in a first mode wherein a single actuation of the interior unlatch input feature may be sufficient to unlatch the powered latch, and a second mode in which the controller requires at least two discreet actuations of the interior unlatch input feature within a predefined time interval to unlatch the powered latch. The controller is configured to utilize the second mode if communication with the control module is interrupted or lost.

The controller may be configured to communicate with the control module utilizing a digital data communication network and one or more electrical conductors extending between the controller and the control module. The controller may be configured to operate in a first mode wherein a single actuation of the interior unlatch input feature may be sufficient to unlatch the powered latch, and a second mode in which the controller requires at least two discreet actuations of the interior unlatch input feature within a predefined time interval to unlatch the powered latch. The controller utilizes the first operating mode if the controller is able to communicate with the control module utilizing at least one of the data communications network and the electrical conductors. The controller utilizes the second operating mode if the controller is unable to communicate properly according to predefined criteria with the control module utilizing either the data communications network or the electrical conductors.

The powered latch may be configured to be connected to a main vehicle electrical power supply, and the powered latch may include a secondary electrical power supply capable of providing sufficient electrical power to actuate the powered actuator if the main vehicle electrical power supply is interrupted. The controller may be operably connected to the powered actuator. The controller is configured to operate in first and second modes. In the first mode, a single actuation of the interior unlatch input feature is sufficient to unlatch the powered latch. In the second mode, the controller requires at least two discreet actuations of the interior unlatch input feature within a predefined time interval to unlatch the powered latch. The controller is configured to utilize the second operating mode if the main vehicle electrical power supply is interrupted.

The controller may be configured to communicate with a control module utilizing a digital data communication network and one or more electrical conductors extending between the controller and the control module. The controller may be configured to operate in first and second modes. In the first mode, a single actuation of the interior unlatch input feature may be sufficient to unlatch the powered latch. In the second mode, the controller is configured to require at least two discreet actuations of the interior unlatch input feature within a predefined time interval to unlatch the powered latch. The controller is configured to utilize the second operating mode if communication with the control module utilizing the digital data communication network is interrupted, even if the controller maintains communication with the control module utilizing the one or more electrical conductors.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
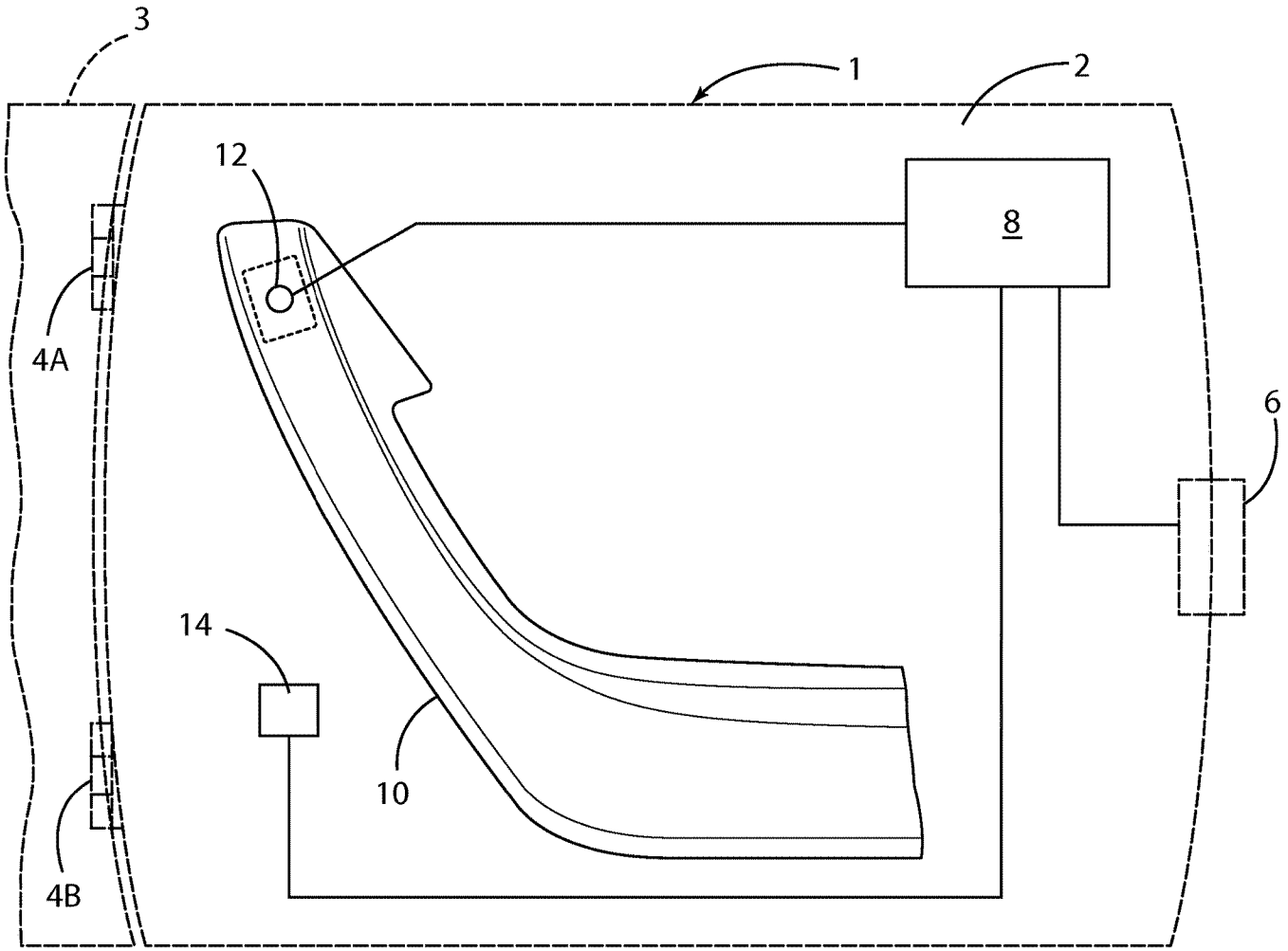
FIG. 1 is a partially schematic view of an interior side of a vehicle door having a powered latch according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a door 1 includes a door structure 2 that may be movably mounted to a vehicle structure 3 in a known manner utilizing hinges 4A and 4B Door 1 may also include an electrically powered latch that is configured to selectively retain the door 1 in a closed position. The powered latch 6 is operably connected to a controller 8. As discussed in more detail below, the controller 8 may comprise an individual control module that is part of the powered latch 6, and the vehicle may include a powered latch 6 at each of the doors of a vehicle. Door 2 may also include an interior unlatch input feature such as an unlatch switch 12 that is operably connected to the controller 8. In use, a user actuates the interior unlatch switch 12 to generate an unlatch request to the controller 8. As also discussed in more detail below, if the latch 6 is unlatched and/or certain predefined operating perimeters or conditions are present, controller 8 generates a signal causing powered latch 6 to unlatch upon actuation of interior unlatch switch 12. Door 2 may also include an unlock input feature such as an unlock switch 14 that is mounted to the door 2. The unlock switch 14 is operably connected to the controller 8. Controller 8 may be configured to store a door or latch lock or unlock state that can be changed by actuation of unlock switch 14. Controller 8 may be configured (e.g. programmed) to deny an unlatch request generated by actuation of the interior unlatch switch 12 if the controller 8 determines that the powered latch 6 is in a locked state. Controller 8 is preferably a programmable controller that can be configured to unlatch powered latch 6 according to predefined operating logic by programming controller 8. However, controller 8 may comprise electrical circuits and components that are configured to provide the desired operating logic.

Figure 2:
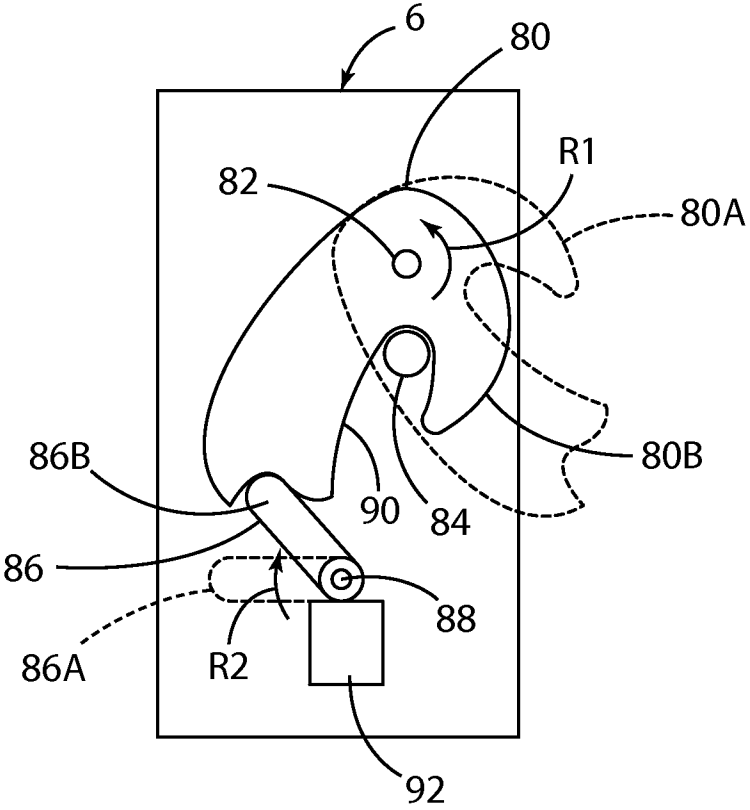
FIG. 2 is a schematic view of a powered latch.

With further reference to FIG. 2, powered latch 6 may include a claw 80 that pivots about a pivot 82 and a pawl 86 that is rotatably mounted for rotation about a pivot 88. Pawl 86 can move between a disengaged or unlatched position 86A and a latched or engaged configuration or position 86B. In use, when door 1 is open, claw 80 will typically be in an extended position 80A. As the door 1 is closed, surface 90 of claw 80 comes into contact with a striker 84 that is mounted to the vehicle structure. Contact between striker 84 and surface 90 of claw 80 causes the claw 80 to rotate about pivot 82 in the direction of the arrow "R1" until the claw 80 reaches the closed position 80B. When claw 80 is in the closed position 80B, and pawl 86 is in the engaged position 86B, pawl 86 prevents rotation of claw 80 to the open position 80A, thereby preventing opening of door 1. Claw 80 may be biased by a spring or the like for rotation in a direction opposite the arrow R1 such that the claw 80 rotates to the open position 80A unless pawl 86 is in the engaged position 86B. Pawl 86 may be biased by a spring or the like in the direction of the arrow R2 such that pawl 86 rotates to the engaged position 86B as claw 80 rotates to the closed position 80B as striker 84 engages claw 80 as door 1 is closed. Latch 6 can be unlatched by rotating pawl 86 in a direction opposite the arrow R2 to thereby permit rotation of claw 80 from the closed position 80B to the open position 80A. A powered actuator such as an electric motor 92 may be operably connected to the pawl 86 to thereby rotate the pawl 86 to the disengaged or unlatched position 86A. Controller 30 can unlatch powered latch 6 to an unlatched configuration or state by causing powered actuator 92 to rotate pawl 86 from the latched or engaged position 86B to the unlatched configuration or position 86A. However, it will be understood that various types of powered latches may be utilized in the present invention, and the powered latch 6 need not include the claw 80 and powered pawl 86 as shown in FIG. 2. For example, powered actuator 92 could be operably interconnected with the claw 80 utilizing a mechanical device other than pawl 86 to thereby shift the powered latch 6 between latched and unlatched states. In general, vehicle door 1 can be pulled open if powered latch 6 is in an unlatched state, but the powered latch 6 retains the vehicle door 1 in a closed position when the powered latch 6 is in a latched state or configuration.

Figure 3:
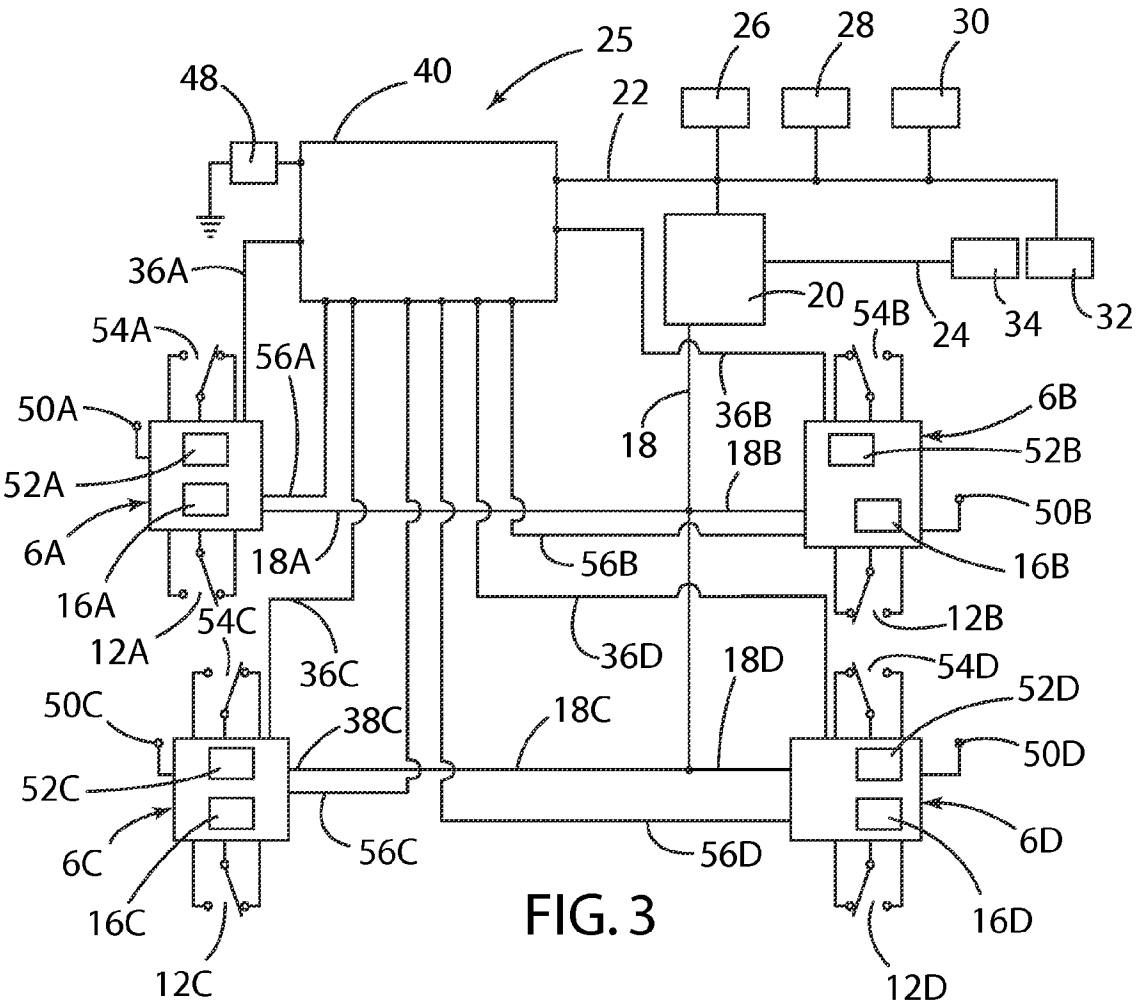
FIG. 3 is a diagram showing a latch system according to one aspect of the present invention.

With further reference to FIG. 3, a latch system 25 may include a driver's side front powered latch 6A, a passenger side front powered latch 6B, a passenger side rear powered latch 6C and a rear passenger side powered latch 6D. The powered latches 6A-6D are configured to selectively retain the corresponding driver and passenger front and rear doors of a vehicle in a closed position. Each of the powered latches 6A-6D may include a controller 16A-16D, respectively, that is connected to a medium speed data network 18 including network lines 18A-18D. Controllers 16A-16D are preferably programmable controllers, but may comprise electrical circuits that are configured to provide the desired operating logic. The data network 18 may comprise a Medium Speed Controller Area Network ("MS-CAN") that operates according to known industry standards. Data network 18 provides data communication between the controllers 16A-16D and a digital logic controller ("DLC") gateway 20. The DLC gateway 20 is operably connected to a first data network 22, and a second data network 24. First data network 22 may comprise a first High Speed Controller Area Network ("HS1-CAN"), and the second data network 24 may comprise a second High Speed Controller Area Network ("HS2-CAN"). The data networks 22 and 24 may operate according to known industry standards. The first data network 22 is connected to an Instrument Panel Cluster ("IPC") 26, a Restraints Control Module ("RCM") 28, and a Power Control Module ("PCM") 30. The RCM 28 utilizes data from acceleration sensors to determine if a crash event has occurred. The RCM 28 may be configured to deploy passenger restraints and/or turn off a vehicle's fuel supply in the vent a crash is detected. The first high speed data network 22 may also be connected to a display screen 32 that may be positioned in a vehicle interior to provide visual displays to vehicle occupants. The second high speed data network 24 is operably connected to antilock brakes ("ABS") module 34 that includes sensors that measure a speed of the vehicle.

System 25 also includes a body control module 40 that is connected to the first high speed data network 22. The body control module 40 is also operably connected to the powered latches 6A-6D by data lines 36A-36D. Controllers 16A-16D may also be directly connected ("hardwired") to control module 40 by electrical conductors such as wires 56A-56D, respectively. Wires 56A-56D may provide a redundant data connection between controllers 16A-16D and controller 40, or the wires 56A-56D may comprise the only data connection between controllers 16A-16D and controller 40. Control module 40 may also be operably interconnected to sensors (not shown) that signal the control module 40 if the vehicle doors are ajar. Control module 40 is also connected to a main vehicle electrical power supply such as a battery 48. Each of the powered latches 6A-6D may be connected to main vehicle power supply 48 by connectors 50A-50D. The powered latches 6A-6D may also include back up power supplies 52 that can be utilized to actuate the powered actuator 92 in the event the power supply from main vehicle power supply 48 is interrupted or lost. The backup power supplies 52 may comprise capacitors, batteries, or other electrical energy storage devices. In general, the backup power supplies 52 store enough electrical energy to provide for temporary operation of controllers 16A-16*d*, and to actuate the powered actuators 92 a plurality of times to permit unlatching of the vehicle doors in the event the main power supply/battery 48 fails or is disconnected.

Each of the powered latches 6A-6D is also operably connected to an interior unlatch switch 12A-12D, respectively, that provide user inputs (unlatch requests). The powered latches 6A-6D are also operably connected to an exterior unlatch switches 54A-54D, respectively. Controllers 16A-16D are also operably connected to unlock switches 14 (FIG. 1). Controllers 16A-16D may be configured to store the Lock Status ("Locked" or "Unlocked") and to utilize the Lock Status for control of powered latches 6A-6D as shown below in Tables 1 and 2.

The controller 40 and individual controllers 16A-16D may be configured to unlatch the powered latches based on various user inputs and vehicle operating perimeters as shown in Table 1:

TABLE 1

| MS-CAN (First Data Network 18) | | | UNLATCH Operation per Door Normal Non-Crash Behavior (Delay Operation to Validate Input was not from a Crash Event) | | | | | |
|---|---|---|---|---|---|---|---|---|
| Or VPWR (Main Vehicle | | LOCK | Exterior Any | Interior Front | Interior Rear Door (First Geographic Region) | | Interior Rear Door (Second Geographic Region) | |
| Power 48) | SPEED | STATUS | Door | Door | Child Lock ON | Child Lock OFF | Child Lock ON | Child Lock OFF |
| OK | Speed < 3 kph | Locked & Alarm Armed | Powered Latch 6 Not Unlatched | Unlatch switch 12 actuated 2 times within 3 seconds | Unlatch switch 12 actuated twice within 3 seconds | Unlatch switch 12 actuated 2 times within 3 seconds | Unlatch switch 12 actuated 2 times within 3 seconds | Unlatch switch 12 actuated 2 times within 3 seconds |
| | | Locked | Powered Latch 6 Not Unlatched | Single actuation of Unlatch switch 12 | Powered Latch 6 Not Unlatched | Unlock switch 14 actuated to unlock, then Unlatch switch 12 actuated 2 times within 3 seconds | Powered Latch 6 Not Unlatched | Single actuation of Unlatch switch 12 |
| | | Unlocked | Single actuation of Unlatch switch 12 | Single actuation of Unlatch switch 12 | Powered Latch 6 Not Unlatched | Single Unlatch | Powered Latch 6 Not Unlatched | Single actuation of Unlatch switch 12 |
| | 3 kph < Speed < 8 kph | ANY | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds |
| | Speed > 8 kph | ANY | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds |
| Lost | Unknown | Unknown | Last Known State | Unlock switch 14 actuated to unlock, then Unlatch switch 12 actuated 2 times within 3 seconds | Unlock switch 14 actuated to unlock, then Unlatch switch 12 actuated 2 times within 3 seconds | Unlock switch 14 actuated to unlock, then Unlatch switch 12 actuated 2 times within 3 seconds | Unlock switch 14 actuated to unlock, then Unlatch switch 12 actuated 2 times within 3 seconds | Unlock switch 14 actuated to unlock, then Unlatch switch 12 actuated 2 times within 3 seconds |

TABLE 2

| MS-CAN (First Data Network 18) Or VPWR (Main Vehicle Power 48) | SPEED | LOCK STATUS | UNLATCH Operation per Door Crash Behavior (Operation After Crash Event Recognized) Exterior Any Door | Interior Front Door | Interior Door (First and Second Geographic Region) Child Lock ON | Child Lock OFF |
|---|---|---|---|---|---|---|
| OK | Speed < 3 kph | Locked & Alarm Armed | State Not Allowed (RCM 28 Off when Security System Armed) | | | |
| | | Locked | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds |
| | | Unlocked | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds |
| | 3 kph < Speed < 8 kph | ANY | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds |
| | Speed > 8 kph | ANY | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds |
| Lost | Unknown | Unknown | Powered Latch 6 Not Unlatched | Unlock switch 14 actuated to unlock, then Unlatch switch 12 actuated 2 times within 3 seconds | Unlock switch 14 actuated to unlock, then Unlatch switch 12 actuated 2 times within 3 seconds | Unlock switch 14 actuated to unlock, then Unlatch switch 12 actuated 2 times within 3 seconds |

As shown in tables 1 and 2, the controllers 16A-16C and/or control module 40 may be configured (e.g. programmed) to control unlatching of powered latches 6A-6D according to different criteria as required for different geographic areas. Additionally, the control module may be configured to control unlatching behavior differently when a crash even condition is present as compared to normal or non-crash conditions. Table 1 represents an example of Unlatching Behavior during normal (non-crash) conditions whereas Table 2 represents example behavior during Crash Conditions. The controllers 16A-16C and/or control module 40 may be configured to recognize a Crash Condition by monitoring the data network for a crash signal from the RCM 28 and/or by monitoring various other direct signal inputs from the RCM 28. As discussed below, the RCM 28 may be configured to determine if a crash event has occurred and generate one or more crash signals that may be communicated to the latch controllers 16A-16C and/or control module 40. Upon recognizing that a crash condition exists, the controller 16A-16C and/or control module 40 may also be configured to initiate a timer and to disallow any unlatching operation for a predefined time interval (e.g. 3 seconds) before resuming the crash behavior (control logic or operating mode) described in Table 2.

The controllers 16A-16D and/or control module 40 may be configured to provide a first operating mode wherein the powered latches 6A-6D are unlatched if interior unlatch switch 12 is actuated once. The system may also include a second operating mode. When the system is in the second operating mode, the interior unlatch switch 12 must be actuated at least two times within a predefined time period (e.g. 3 seconds). For example, this operating mode may be utilized when the vehicle is locked and the vehicle security system is armed.

As discussed above, the control module 40 may be operably interconnected with the controllers 16A-16D by data network 8 and/or data lines 36A-36D. Control module 40 may also be operably interconnected with the controllers 16A-16D by "hard" lines 56A-56D. The system 25 may also be configured such that the control module 40 is connected to the controllers 16A-16D only by network 18, only data lines 36A-36D, or only by conductors 38A-38D.

During normal operation, or when the vehicle is experiencing various operating failures, the system 25 may also be configured to control the powered latches 6A-6D based on various operating parameters and/or failures within the vehicles electrical system, the data communication network, the hardwires, and other such parameters or events.

For example, during normal operation the system 25 may be configured to unlatch powered latches 6A-6D if interior unlatch switch 12 is actuated at least once and if the vehicle is traveling below 3 kph or other predefined speed. The speed may be determined utilizing suitable sensors (e.g. sensors in ABS module 34). If the vehicle is traveling at or below 3 kph, the powered latches 6A-6D may also be unlatched if exterior unlatch switch 54 is actuated one or more times while unlocked. However, the controllers 16A-16D may be configured such that if the vehicle is traveling above 3 kph, the latches 6A-6D cannot be unlatched by actuating exterior unlatch switches 54A-54D. Likewise, if the vehicle is traveling below 3 kph and while locked and armed, the system 25 may be configured to unlatch powered latches 6A-6D if interior unlatch switches 12A-12D are actuated at least two times within a predefined time interval (e.g. 3 seconds).

The system 25 may be configured to debounce interior unlatch switches 12A-12D and/or exterior unlatch switches 54A-54D at a first time interval (e.g. 35 ms) during normal vehicle operation. However, the debounce may be performed at longer time intervals (100-150 ms) if the vehicle is in gear (e.g. PCM 30 provides a signal indicating that the vehicle transmission gear selector is in a position other than "Park" or "Neutral").

Furthermore, the system 25, in crash operation for example, may be configured to unlatch the powered latches 6A-6D based on multiple inputs from interior unlatch switch 12 and/or interior unlock switch 14. Specifically, the controllers 16A-16D may be configured to provide a three-input mode or feature and unlatch powered latches 6A-6D if three separate inputs from interior unlatch switches 12A-12D and interior unlock switches 14A-14D are received within a predefined time interval (e.g. 3 seconds or 5 seconds) in any sequence. For example, controllers 16A-16D may be configured such that three actuations of interior unlatch switch 12 or three actuations of unlock switch 14 within the predefined time interval results in unlatching of powered latches 6A-6D. Also, actuation of unlock switch 14 followed by two actuations of unlatch switch 12 within the predefined time period could be utilized as a combination of inputs that would unlatch powered latches 6A-6D. Similarly, two actuations of the unlatch switch 12 followed by a single actuation of unlock switch 14 within the predefined time period may be utilized as an input that causes the powered latches 6A-6D to unlatch. Still further, two actuations of unlock switch 14 followed by a single actuation of interior unlatch switch 12 could also be utilized as a combination of inputs resulting in unlatching of powered latches 6A-6D. Thus, three inputs from unlatch switch 12 and/or unlock switch 14 in any combination or sequence within a predefined time interval may be utilized by the system 25 to unlatch powered latches 6A-6D. This control scheme prevents inadvertent unlatching of powered latches 6A-6D, but also permits a user who is under duress to unlatch the doors if three separate inputs in any sequence or combination are provided. Additionally, system 25 may be configured such that the three-input mode/feature is active only under the presence of certain conditions. For example, the system 25 (e.g. controllers 16A-16D) may be configured to provide a three-input mode-feature if a crash condition is present and/or loss of data network condition occurs as recognized by the controllers 16A-16D.

If the system 25 includes only data network connections 36A-36D, or only includes "hardwire" lines 56A-56D, the controllers 16A-16D may be configured to require a plurality of actuations of interior unlatch switch 12 if either the network or hardwire connectivity with RCM 28 is lost. If the controllers 16A-16D cannot communicate with the RCM 28, the controllers 16A-16D do not "know" the status of RCM 28, such that the controllers 16A-16D cannot "know" if a crash or fuel cut-off event has occurred. Accordingly, the controllers 16A-16D can be configured to default to require multiple actuations of interior unlatch switches 12A-12D in the event communication with RCM 28 (or other components) is lost to insure that the powered latches 6A-6D are not inadvertently unlatched during a crash event that was not detected by the system due to a loss of communication with the RCM 28. Similarly, if the network connectivity is lost, the controllers 16A-16D will be unable to "know" the vehicle speed and may default to utilizing the last known valid vehicle speed. Alternatively, the controllers 16A-16D may be configured instead to assume by default that the vehicle speed is less than 3 kph if network connectivity is lost. This may be utilized in the unlatch operation behavior from processing the exterior unlatch switches 54A-54D and/or the interior switches. It will be understood that controllers 16A-16D may be configured to determine if network connectivity has been "lost" for purposes of controlling latch operations based on predefined criteria (e.g. an intermittent data connection) that does not necessarily require a complete loss of network connectivity.

Similarly, if the system 25 includes both network connections 36A-36D and "hard" lines 56A-56D, the controllers 16A-16D may be configured to default to a mode requiring multiple actuations of interior unlatch switch 12 if both the data and hardwire connections are disrupted or lost. However, if either of the data or hardwire connections remain intact, the controllers 16A-16D can be configured to require only a single actuation of interior unlatch switch 12, provided the vehicle is known to be below a predefined maximum allowable vehicle speed and other operating parameters that would otherwise trigger a requirement for multiple actuations of interior unlatch switches 12A-12D.

Furthermore, the controllers 16A-16D may be configured to default to a mode requiring multiple actuations of interior unlatch switches 12A-12D if the power to latches 6A-6D from main vehicle power supply 48 is interrupted, even if the network connectivity with RCM 28 remains intact. This may be done to preserve the backup power supplies 52A-52D. Specifically, continued monitoring of the data network by controllers 16A-16D will tend to drain the backup power supplies 52A-52D, and the controllers 16A-16D may therefore be configured to cease monitoring data from data lines 36A-36D and/or network 18 in the event power from main vehicle power supply 48 is lost. Because the controllers 16A-16D cease monitoring the data communication upon failure of main power supply 48, the individual controllers 16A-16D cannot determine if a crash event has occurred (i.e. the controllers 16A-16D will not receive a data signal from RCM 28), and the controllers 16A-16D therefore default to require multiple actuations of interior unlatch switches 12A-12D to insure that the latches 6A-6D are not inadvertently unlatched during a crash event that was not detected by controllers 16A-16D. Additionally, in such cases the controllers 16A-16D will likewise be unable to determine vehicle speed and may be configured (e.g. programmed) to default to utilizing the last known valid vehicle speed. Alternatively, the controllers 16A-16D may instead be configured to "assume" by default that the vehicle speed is less than a predefined speed (e.g. 3 kph). These defaults, assumptions may be utilized in the unlatch operation behavior when processing inputs from the exterior unlatch switches 54A-54D and/or the interior switches 12A-12D.

Furthermore, the system may be configured to default to require multiple actuations of interior unlatch switches 12A-12D in the event the data network connection (network 18 and/or data lines 36A-36D) connectivity between the controllers 16A-16D and RCM 28 is lost. Specifically, even if the "hard" lines 56A-56D remain intact, the data transfer rate of the hard lines 56A-56D is significantly less than the data transfer rate of the network 18 and data lines 36A-36D, such that the controllers 16A-16D may not receive crash event data from RCM 28 quickly enough to shift to a mode requiring multiple actuations of interior unlatch switches 12A-12D if the crash data can only be transmitted over the hard lines 38A-38D. Thus, defaulting to a mode requiring multiple actuations of interior unlatch switches 12A-12D upon failure of data communications (network 18 and/or data lines 36A-36D) even if the hardwire communication lines remain intact insures that the powered latches 6A-6D are not inadvertently unlatched during a crash event that was detected by the controllers 16A-16D only after a delay due to a slower data transfer rate. Similarly, in such cases where the controllers 16A-16D are not communicating over the data network, they will be unable to "know" the vehicle speed as well and my default to utilizing the last known valid vehicle speed. Alternatively, the controllers 16A-16D may instead be configured to "assume" by default that the vehicle speed is less than a predefined speed (e.g. 3 kph). These defaults/assumptions may be utilized in the unlatch operation behavior when processing inputs from the exterior unlatch switches 54A-54D and/or the interior switches 12A-12D.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A latch system for vehicle doors, the latch system comprising:

a powered latch including a powered actuator that is configured to unlatch the powered latch;

an interior unlatch input feature that can be actuated by a user to provide an unlatch request;

a logic device;

a first control module that is configured to utilize acceleration data to determine if a crash event has occurred;

a second control module configured to detect other inputs on the vehicle;

a controller;

a first data network operatively interconnecting the second control module and the logic device;

a second data network operatively connecting the logic device to the controller;

one or more electrical conductors extending between the controller and the second control module;

wherein the controller is configured to communicate with the first control module utilizing the logic device and the first and second data networks, and with the second control module utilizing the one or more electrical conductors extending between the controller and the second control module, and wherein the controller is configured to operate in a first operating mode under normal operating conditions, wherein a single actuation of the interior unlatch input feature may be sufficient to unlatch the powered latch in the first operating mode, and a second operating mode that is utilized when communications are at least partially interrupted, and in which the controller requires at least two discrete actuations of the interior unlatch input feature within a predefined time interval to unlatch the powered latch, and wherein the controller utilizes the first operating mode if the controller is able to communicate with at least one of the first and second control modules utilizing at least one of the first and second data networks and the electrical conductors, and wherein the controller utilizes the second operating mode if the controller is unable to communicate with the first and second control modules utilizing either the first and second data networks or the electrical conductors.

2. The latch system of claim 1, wherein:

the controller is configured to determine that a loss of communications has occurred if communication does not occur for at least a predefined period of time.

3. A latch system for vehicle doors, the latch system comprising:

a powered latch including a powered actuator that is configured to unlatch the powered latch;

an interior unlatch input feature that can be actuated by a user to provide an unlatch request;

a logic device;

a first control module that is configured to utilize acceleration data to determine if a crash event has occurred; and a second control module configured to detect other inputs on the vehicle;

a controller;

a first data network operatively interconnecting the second control module and the logic device;

a second data network operatively connecting the logic device to the controller;

one or more electrical conductors extending between the controller and the second control module;

and wherein the controller is configured to communicate with the first control module utilizing the logic device and the first and second data networks and with the second control module utilizing the one or more electrical conductors extending between the controller and the second control module, and wherein the controller is configured to operate in a first operating mode under normal operating conditions, wherein a single actuation of the interior unlatch input feature may be sufficient to unlatch the powered latch, and a second operating mode that is utilized when communications are at least partially interrupted, and in which the controller requires at least two discrete actuations of the interior unlatch input feature within a predefined time interval to unlatch the powered latch, and wherein the controller utilizes the second operating mode if communication with the first control module utilizing the first and second data networks is interrupted even if the controller maintains communication with the second control module utilizing the one or more electrical conductors.

* * * * *